US012365960B2

(12) United States Patent
Fluch et al.

(10) Patent No.: US 12,365,960 B2
(45) **Date of Patent: *Jul. 22, 2025**

(54) DRILL STRING COMPONENT WITH HIGH CORROSION RESISTANCE, AND METHOD FOR THE PRODUCTION OF SAME

(71) Applicants: voestalpine BÖHLER Edelstahl GmbH & Co KG, Kapfenberg (AT); Schoeller-Bleckmann Oilfield Technology, Ternitz (AT)

(72) Inventors: Rainer Fluch, St. Lorenzen im Mürztal (AT); Andreas Keplinger, Leoben (AT); Martin Wöls, Aflenz (AT); Bernd Holper, Pinkafeld (AT); Walter Spruzina, Aue (AT)

(73) Assignees: Voestalpine BOHLER Edelstahl GmbH & Co., Kapfenberg (AT); Schoeller-Bleckmann Oilfiend Technology, Ternitz (AT)

( * ) Notice: Subject to any disclaimer, the term of this patent is extended or adjusted under 35 U.S.C. 154(b) by 946 days.

This patent is subject to a terminal disclaimer.

(21) Appl. No.: 17/297,388

(22) PCT Filed: Dec. 19, 2019

(86) PCT No.: PCT/EP2019/086381
§ 371 (c)(1),
(2) Date: May 26, 2021

(87) PCT Pub. No.: WO2020/127786
PCT Pub. Date: Jun. 25, 2020

(65) Prior Publication Data

US 2022/0033924 A1 Feb. 3, 2022

(30) Foreign Application Priority Data

Dec. 20, 2018 (DE) ..... 10 2018 133 251.3

(51) Int. Cl.
*C22C 38/40* (2006.01)
*C21D 6/00* (2006.01)
(Continued)

(52) U.S. Cl.
CPC ..... *C21D 9/44* (2013.01); *C21D 6/004* (2013.01); *C21D 6/005* (2013.01); *C21D 6/008* (2013.01);
(Continued)

(58) Field of Classification Search
CPC ..... C22C 38/001; C22C 38/44; C22C 38/18; C22C 38/38; C22C 38/40; C22C 38/58
See application file for complete search history.

(56) References Cited

U.S. PATENT DOCUMENTS 4,554,028 A * 11/1985 DeBold ..... C22C 38/001 148/327
9,803,267 B2 10/2017 Roscoe
(Continued)

FOREIGN PATENT DOCUMENTS

AT 277302 B 12/1969
CA 1238841 7/1988
(Continued)

OTHER PUBLICATIONS

International Search Report and Written Opinion for PCT/EP2019/086381, dated Feb. 20, 2020.
(Continued)

*Primary Examiner* — Lois L Zheng
(74) *Attorney, Agent, or Firm* — Maxwell J. Petersen; FisherBroyles, LLP

(57) ABSTRACT

A drill string component, in particular a drilling collar component, an MWD component, or an LWD component for use in oilfield technology and particularly in deep drilling, is provided. A method of making a drill string
(Continued)

component, and a steel alloy useful in making a drill string component, are also provided.

17 Claims, 1 Drawing Sheet

(51) Int. Cl.

| | |
|---|---|
| ***C21D 8/06*** | (2006.01) |
| ***C21D 9/44*** | (2006.01) |
| ***C22C 38/00*** | (2006.01) |
| ***C22C 38/02*** | (2006.01) |
| ***C22C 38/42*** | (2006.01) |
| ***C22C 38/44*** | (2006.01) |
| ***C22C 38/46*** | (2006.01) |
| ***C22C 38/58*** | (2006.01) |
| ***E21B 17/00*** | (2006.01) |

(52) U.S. Cl.
CPC ..... *C21D 8/065* (2013.01); *C22C 38/001* (2013.01); *C22C 38/02* (2013.01); *C22C 38/42* (2013.01); *C22C 38/44* (2013.01); *C22C 38/46* (2013.01); *C22C 38/58* (2013.01); *E21B 17/00* (2013.01); *C21D 2211/001* (2013.01)

(56) References Cited

U.S. PATENT DOCUMENTS

| | | | |
|---|---|---|---|
| 2022/0145436 | A1 | 5/2022 | Fluch et al. |
| 2024/0052469 | A2 | 2/2024 | Fluch et al. |

FOREIGN PATENT DOCUMENTS

| | | | | |
|---|---|---|---|---|
| CA | 3122044 | A1 | 6/2020 | |
| CN | 106555133 | A | 4/2017 | |
| CN | 104040012 | B * | 5/2017 | ..... C22C 38/44 |
| CN | 106795606 | A | 5/2017 | |
| DE | 3445056 | | 6/1985 | |
| DE | 3837457 | | 12/1989 | |
| DE | 3837457 | C1 | 12/1989 | |
| DE | 3837456 | C1 | 3/1990 | |
| DE | 29921813 | U1 | 2/2000 | |
| EP | 0342574 | A1 | 5/1989 | |
| EP | 1577414 | A2 | 9/2005 | |
| EP | 1577414 | A3 | 11/2005 | |
| EP | 2794949 | A0 | 10/2014 | |
| EP | 3899064 | A1 | 6/2020 | |
| GB | 778597 | | 2/1956 | |
| JP | S55021547 | A | 2/1980 | |
| JP | H0426740 | A | 1/1992 | |
| JP | H09279315 | A | 10/1997 | |
| JP | 2005179733 | | 7/2005 | |
| JP | 2005179733 | A | 7/2005 | |
| JP | 281855 | A | 10/2005 | |
| KR | 20030057135 | | 7/2003 | |
| KR | 20030057135 | A | 7/2003 | |
| TW | 201741473 | A | 12/2017 | |
| WO | 1997012072 | A1 | 4/1997 | |
| WO | 0164969 | | 9/2001 | |
| WO | 20005073424 | A1 | 8/2005 | |
| WO | 2013130139 | A2 | 9/2013 | |
| WO | 2013130139 | A3 | 9/2013 | |
| WO | 2011040381 | A1 | 12/2013 | |
| WO | 2020127788 | A1 | 6/2020 | |
| WO | 20200127789 | A1 | 6/2020 | |

OTHER PUBLICATIONS

German Office Action dated Sep. 23, 2019 for German Patent Application 10 2018 133 251.3.

* cited by examiner

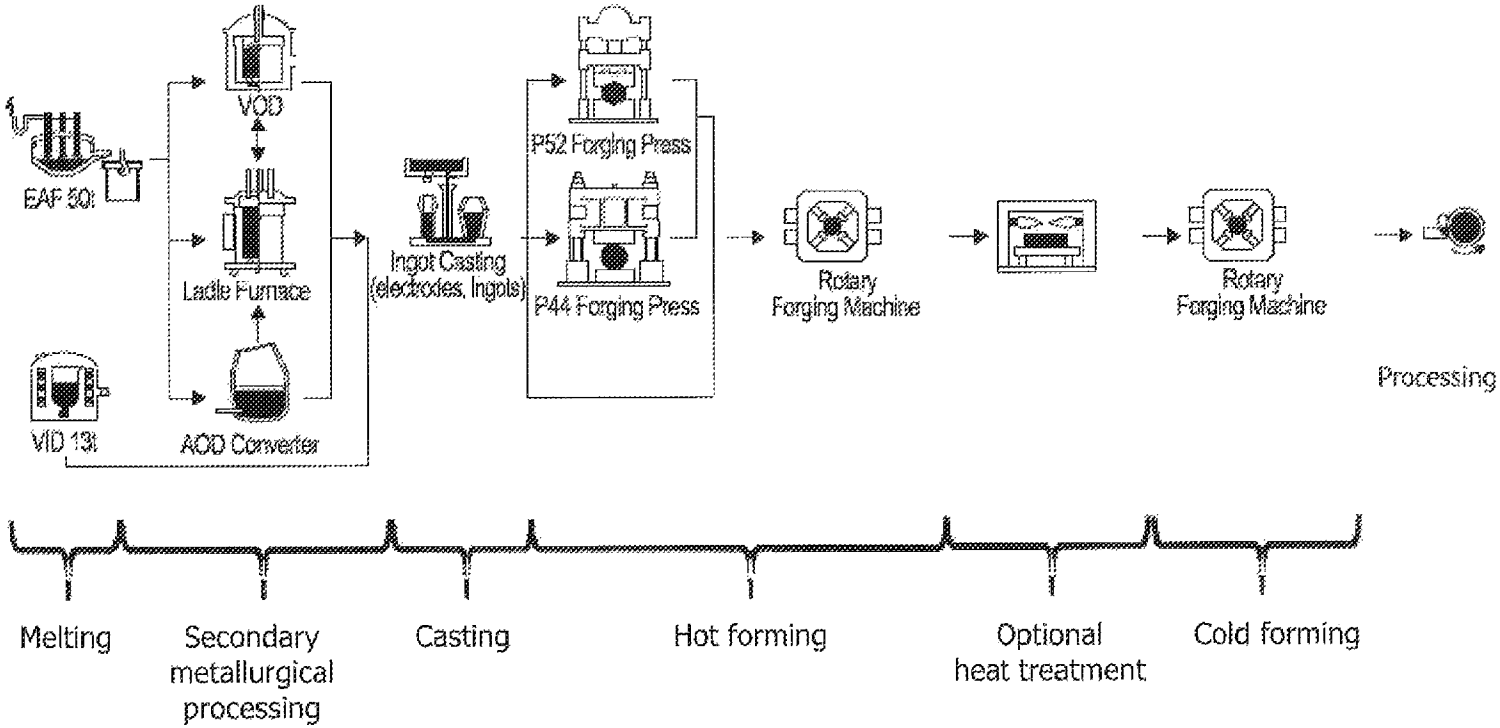
EAF 30t
VOD
Ladle Furnace
VID 13t
AOD Converter
Ingot Casting (electrodes, Ingots)
P52 Forging Press
P44 Forging Press
Rotary Forging Machine
Rotary Forging Machine
Processing
Melting
Secondary metallurgical processing
Casting
Hot forming
Optional heat treatment
Cold forming

DRILL STRING COMPONENT WITH HIGH CORROSION RESISTANCE, AND METHOD FOR THE PRODUCTION OF SAME

FIELD OF THE INVENTION

The invention relates to a drill string component, particularly for use in highly corrosive mediums and a method for producing it.

BACKGROUND OF THE INVENTION

In deep drilling technology, particularly in oilfield or gas field technology, it is necessary to determine a bore hole path as exactly as possible. In particular, this also relates to bores in which drilling is not exclusively performed perpendicularly or vertically, but also to bores in which direction changes are carried out in the course of drilling. In this connection, it is necessary to determine the bore hole path as exactly as possible in order to be able to correspondingly control the bore hole path. This is usually carried out by determining the position of the drilling head with the aid of magnetic field probes in which the earth's magnetic field is used for measurement. For this purpose, certain components of the drill string are made of nonmagnetic alloys. This means that usually, parts of drill strings in the immediate vicinity of magnetic field probes must have a relative magnetic permeability $\mu_R<0.1$.

In particular, such parts include the so-called drilling collars or MWD parts (measurement while drilling) and LWD parts (logging while drilling), which are positioned above the actual drilling head and among other things, are used to accommodate the corresponding measurement electronics.

In order to ensure that the alloys from which these drilling collars are made are not magnetic, it is necessary to rely on using nonferritic steel alloys. Basically, these are fully austenitic and superaustenitic alloys.

Another requirement of drill string components, though, is that they must also resist corrosion, in particular corrosion in mediums with high chloride concentrations.

This also relates to the fact that drill string components are subjected to particularly high alternating torsion load stresses and torsional stresses. In this case, a corrosive attack would, due to vibration crack corrosion, bring about a weakening, which reduces the theoretical service life of such a drill string component.

It is also important not only to produce such drill string components from the appropriate alloys, but also through appropriate post-processing procedures, to ensure that a homogeneous, high-strength, and in particular highly impact-resistant structure is present in which no crack initiation is caused by the presence, for example, of intermetallic phases, coarse carbides, or the like.

For this reason, in order to be suitable particularly for deep-drilled holes, drill string components of this kind are selected so that the minimum values of the mechanical properties, in particular the 0.2% yield strength and tensile strength, are equal to the dynamically changing loads that occur.

A drill string component of this kind is known, for example, from AT 412727 B.

The corrosion-resistant austenitic steel alloy selected here is an alloy that has in particular high concentrations of manganese, chromium, molybdenum, and nickel.

In order to establish a high strength, nitrogen concentrations of 0.35% by weight to 1.05% by weight are present; the nitrogen is intended to also contribute to the corrosion resistance and is a powerful austenite promoter. On the other hand, with increasing nitrogen content, there is a tendency for nitrogen-containing precipitations to form, in particular chromium nitride.

In order to achieve this high nitrogen solubility, in particular manganese concentrations of greater than 19-30% by weight are provided. This is intended to ensure the ability to produce pore-free materials even with solidification at atmospheric pressure. Apart from this, with high degrees of deformation, the manganese should stabilize the austenite structure to prevent the formation of deformation-induced martensite.

EP 1 069 202 A1 has disclosed a paramagnetic, corrosion-resistant, austenitic steel with a high yield strength, strength, and toughness, which should be corrosion-resistant particularly in mediums with a high chloride concentration; this steel should contain 0.6% by mass to 1.4% by mass nitrogen, 17 to 24% by mass chromium, and manganese.

WO 02/02837 A1 has disclosed a corrosion-resistant material for use in mediums with a high chloride concentration in oilfield technology. In this case, it is a chromium-nickel-molybdenum superaustenite, which is embodied with comparatively low nitrogen concentrations, but very high chromium concentrations and very high nickel concentrations.

By comparison to the previously mentioned chromium-manganese-nitrogen steels, these chromium-nickel-molybdenum steels usually have an even better corrosion behavior. By and large, chromium-manganese-nitrogen steels constitute a rather inexpensive alloy composition, which nevertheless offers an outstanding combination of strength, toughness, and corrosion resistance. The above-mentioned chromium-nickel-molybdenum steels achieve significantly higher corrosion resistances than chromium-manganese-nitrogen steels, but entail significantly higher costs because of the very high nickel content.

Usually, superaustenites have molybdenum concentrations>4% in order to achieve the high corrosion resistance values. But molybdenum increases the segregation tendency and thus produces an increased susceptibility to precipitation, particularly of sigma or chi phases. This results in the fact that these alloys require a homogenization annealing and at values above 4% molybdenum, a remelting is required in order to reduce the segregation.

Basically, it is necessary for the materials to still have a magnetic permeability of $\mu_r<1.01$ even after a cold deformation.

Steels of this kind usually have a yield strength $R_{p0.2}$ of 140 KSI=965 MPa.

Characteristic values for the corrosion resistance include among others the so-called $PREN_{16}$ value; it is also customary to define the so-called pitting resistance equivalent number by means of $MARC_{OPT}$; a superaustenite is identified as having a $PREN_{16}$ of $\alpha>42$, where PREN=% Cr+3.3×% Mo+16×% N.

The known MARC formula for describing the pitting resistance for steels of this kind is the following: MARC=Cr+3.3 Mo+20 N+20 C−0.25 Ni−0.5 Mn.

Classic drilling collar steels are the chromium-manganese-nitrogen steels that have already been mentioned because despite their outstanding properties, they are still relatively inexpensive. In this case, they are used without niobium; because of the higher manganese concentrations, manganese sulfides form, which has a negative effect on the corrosion properties.

Comparable steel grades are also known for use as shipbuilding steels for submarines; in this case, these are chromium-nickel-manganese-nitrogen steels, which are also alloyed with niobium in order to stabilize the carbon, but this diminishes the notched-bar toughness. Basically, these steels contain little manganese and as a result, have a relatively good corrosion resistance, but they do not yet achieve the strength of drilling collar grades and in particular, do not achieve their ductility toughness.

SUMMARY OF THE INVENTION

The object of the invention is to produce a drill string component, in particular for use in oilfield technology, in particular a drilling collar, which exhibits a corrosion resistance, a high strength, and good paramagnetic behavior.

The object is attained with a component having the following features. Advantageous modifications are disclosed and claimed herein.

A drill string component, in particular a drilling collar component, an MWD component, or an LWD component for use in oilfield technology and particularly in deep drilling, including an alloy with the following composition (all values expressed in % by weight) as well as inevitable impurities:

| Elements | |
|---|---|
| Carbon (C) | 0.01-0.25 |
| Silicon (Si) | <0.5 |
| Manganese (Mn) | 3.0-8.0 |
| Phosphorus (P) | <0.05 |
| Sulfur (S) | <0.005 |
| Iron (Fe) | residual |
| Chromium (Cr) | 23.0-30.0 |
| Molybdenum (Mo) | 2.0-4.0 |
| Nickel (Ni) | 10.0-16.0 |
| Vanadium (V) | <0.5 |
| Tungsten (W) | <0.5 |
| Copper (Cu) | <0.5 |
| Cobalt (Co) | <5 |
| Titanium (Ti) | <0.1 |
| Aluminum (Al) | <0.2 |
| Niobium (Nb) | <0.1 |
| Boron (B) | <0.01 |
| Nitrogen (N) | 0.50-0.90 |

Another object of the invention is to create a method for producing the component, which produces a drill string component, which along with an increased corrosion resistance, exhibits a high strength and a good paramagnetic behavior.

The object is attained with a method including the following steps. Advantageous modifications are disclosed and claimed herein.

A method for producing a drill string component, characterized in that an alloy with the following components (all values expressed in % by weight) as well as inevitable impurities:

| Elements | |
|---|---|
| Carbon (C) | 0.01-0.25 |
| Silicon (Si) | <0.5 |
| Manganese (Mn) | 3.0-8.0 |
| Phosphorus (P) | <0.05 |
| Sulfur (S) | <0.005 |
| Iron (Fe) | Residual |
| Chromium (Cr) | 23.0-30.0 |

-continued

| Elements | |
|---|---|
| Molybdenum (Mo) | 2.0-4.0 |
| Nickel (Ni) | 10.0-16.0 |
| Vanadium (V) | <0.5 |
| Tungsten (W) | <0.5 |
| Copper (Cu) | <0.5 |
| Cobalt (Co) | <5.0 |
| Titanium (Ti) | <0.1 |
| Aluminum (Al) | <0.2 |
| Niobium (Nb) | <0.1 |
| Boron (B) | <0.01 |
| Nitrogen (N) | 0.50-0.90 |

is melted and then undergoes secondary metallurgical processing, then the resulting alloy is cast into blocks and allowed to solidify, and then is heated and then immediately hot formed by means of forging, with the forged components undergoing an additional cold forming and subsequent mechanical processing.

When percentage values are given below, they are always expressed in wt % (percentage by weight).

According to the invention, the drill string component should have a fully austenitic structure in particular without deformation-induced martensite even after the cold forming; the magnetic permeability is $\mu_r<1.01$, preferably $\mu_r<1.005$. Since ferrite or deformation-induced martensite exhibit a magnetic behavior, they consequently increase the permeability and should therefore be avoided according to the invention.

After the hot forming step to which the cast block has been subjected, the yield strength is $R_{p0.2}>450$ MPa and can easily attain values>500 MPa; the notched bar impact work at 20° C. is greater than 350 J and even values of up to 440 J can be achieved.

After the strain hardening, the yield strength is reliably $R_{p0.2}>1000$ MPa and experience has shown that values of up to 1100 MPa are achieved; after the strain hardening, the notched bar impact work at 20° C. is reliably greater than 80 J and experience has shown that values of 200 J are achieved.

The notched bar impact work was determined in accordance with DIN EN ISO 148-1.

This outstanding combination of strength and toughness was not previously achievable and was also not expected and is accomplished by the special alloying state according to the invention, which produces this synergistic effect.

According to the invention, it is possible to achieve values for the product of tensile strength Rm multiplied by the notched-bar toughness KV that are greater than 100000 MPa J, preferably >200000 MPa J, and particularly preferably >300000 MPa J.

The alloy according to the invention comprises the following elements (all values expressed in % by weight):

| Elements | | Preferred | More preferred |
|---|---|---|---|
| Carbon (C) | 0.01-0.25 | 0.01-0.2 | 0.01-0.1 |
| Silicon (Si) | <0.5 | <0.5 | <0.5 |
| Manganese (Mn) | 3.0-8.0 | 4.0-7.0 | 5.0-6.0 |
| Phosphorus (P) | <0.05 | <0.05 | <0.05 |
| Sulfur (S) | <0.005 | <0.005 | <0.005 |
| Iron (Fe) | residual | residual | residual |
| Chromium (Cr) | 23.0-30.0 | 24.0-28.0 | 26.0-28.0 |
| Molybdenum (Mo) | 2.0-4.0 | 2.5-3.5 | 2.5-3.5 |
| Nickel (Ni) | 10.0-16.0 | 12.0-15.5 | 13.0-15.0 |

-continued

| Elements | | Preferred | More preferred |
|---|---|---|---|
| Vanadium (V) | <0.5 | <0.3 | below detection level |
| Tungsten (W) | <0.5 | <0.1 | below detection level |
| Copper (Cu) | <0.5 | <0.15 | <0.1 |
| Cobalt (Co) | <5.0 | <0.5 | below detection level |
| Titanium (Ti) | <0.1 | <0.05 | below detection level |
| Aluminum (Al) | <0.2 | <0.1 | <0.1 |
| Niobium (Nb) | <0.1 | <0.025 | below detection level |
| Boron (B) | <0.01 | <0.005 | <0.005 |
| Nitrogen (N) | 0.50-0.90 | 0.52-0.85 | 0.54-0.80 |

The residue consists of 100% iron (as noted in the table) and inevitable impurities.

The first column (at the far left) shows the composition with which it is basically possible to achieve a drilling collar according to the invention that has the respective positive properties. Preferred variants are shown in the subsequent columns, but not all of the alloy elements absolutely have to be present in limited amounts; for example, it is also conceivable for there to be a combination of 5.2% Mn with 23.1% chromium.

With such an alloy, the positive properties of different steel grades are combined.

With the alloy according to the invention, it is entirely surprising that very high nitrogen values can be established, which is extremely good for the strength; these nitrogen values are surprisingly higher than those that are indicated as possible in the technical literature. According to empirical methods, the high nitrogen concentrations of the alloy according to the invention are not at all possible.

The respective elements are described in detail below, in combination with the other alloy components where appropriate. All indications relating to the alloy composition are expressed in percentage by weight (wt %). Upper and lower limits of the individual alloy elements can be freely combined with each other within the limits of the claims.

Carbon can be present in a steel alloy according to the invention at concentrations of up to 0.25%. Carbon is an austenite promoter and has a beneficial effect with regard to high mechanical characteristic values. With regard to avoiding carbide precipitation, the carbon content can be set between 0.01 and 0.1% by weight.

Silicon is provided in concentrations of up to 0.5% by weight and mainly serves to deoxidize the steel. The indicated upper limit reliably avoids the formation of intermetallic phases. Since silicon is also a ferrite promoter, in this regard as well, the upper limit is selected with a safety range. In particular, silicon can be provided in concentrations of 0.1-0.3% by weight.

Manganese is present in concentrations of 3-8% by weight. In comparison to materials according to the prior art, this is an extremely low value. Up to this point, it has been assumed that manganese concentrations of greater than 19% by weight, preferably greater than 20% by weight, are required for a high nitrogen solubility. With the present alloy, it has surprisingly turned out that even with the low manganese concentrations according to the invention, a nitrogen solubility is achieved that is greater than what is possible according to the prevailing consensus among experts. But according to the invention, it has turned out that due to unexplained synergistic effects, this is clearly not necessary with the present alloy. The lower limit for manganese can be selected as 3.0, 3.5, 4.0, 4.5, or 5.0%. The upper limit for manganese can be selected as 6.0, 6.5, 7.0, 7.5, or 8.0%.

The upper limit for copper can be selected as <0.5% by weight, <0.15% by weight, <0.10% by weight, or below the detection level (i.e. without any intentional addition to the alloy). Although according to the literature, the addition of copper to the alloy turns out to be advantageous for the resistance in sulfuric acid, it has turned out that at values>0.5%, copper increases the precipitation tendency of chromium nitrides, which has a negative effect on the corrosion properties. According to the invention, therefore, the upper limit is set to 0.5%.

In concentrations of 17% by weight or more, chromium turns out to be necessary for a higher corrosion resistance. According to the invention, a concentration of at least 23% and at most 30% chromium is present. Up to this point, it has been assumed that concentrations higher than 24% by weight have a disadvantageous effect on the magnetic permeability because chromium is one of the ferrite-stabilizing elements. By contrast, in the alloy according to the invention, it has been determined that even very high chromium concentrations above 23% do not negatively influence the magnetic permeability in the present alloy but instead—as is known—influence the resistance to pitting and stress crack corrosion in an optimal way. The lower limit for chromium can be selected as 23, 24, 25, or 26%. The upper limit for chromium can be selected as 28, 29, or 30%.

Molybdenum is an element that contributes significantly to corrosion resistance in general and to pitting corrosion resistance in particular; the effect of molybdenum is intensified by nickel. According to the invention, 2 to 4% by weight molybdenum is added. The lower limit for molybdenum can be selected as 2.0, 2.1, 2.2, 2.3, 2.4, or 2.5. The upper limit for molybdenum can be selected as 3.5, 3.6, 3.7, 3.8, 3.9, or 4.0%. Higher concentrations of molybdenum make an ESR treatment absolutely necessary in order to prevent occurrences of segregation. Remelting procedures are very complex and expensive. For this reason, PESR or ESR routes are to be avoided according to the invention.

According to the invention, tungsten is present in concentrations of less than 0.5% and contributes to increasing the corrosion resistance. The upper limit for tungsten can be selected as 0.5, 0.4, 0.3, 0.2, 0.1%, or below the detection level (i.e. without any intentional addition to the alloy).

According to the invention, nickel is present in concentrations of 10 to 16%, which achieves a high stress crack corrosion resistance in mediums containing chloride. The lower limit for nickel can be selected as 10, 11, 12, or 13%. The upper limit for nickel can be selected as 15, 15.5, or 16%.

Cobalt can be present in concentrations of up to 5% by weight, particularly in order to substitute for nickel. The upper limit for cobalt can be selected as 5, 3, 1, 0.5, 0.4, 0.3, 0.2, 0.1%, or below the detection level (i.e. without any intentional addition to the alloy).

Nitrogen in concentrations of 0.50 to 0.90% by weight is included in order to ensure a high strength. Nitrogen also contributes to the corrosion resistance and is a powerful austenite promoter, which is why concentrations of greater than 0.52% by weight, in particular greater than 0.54% by weight are beneficial. In order to avoid nitrogen-containing precipitations, in particular chromium nitride, the upper limit of nitrogen is set to 0.90% by weight; it has turned out that despite the very low manganese content, by contrast with known alloys, these high nitrogen concentrations in the alloy can be achieved without any pressure-induced nitrogen content increase (PESR).

Because of the good nitrogen solubility on the one hand and the disadvantages that result from higher nitrogen concentrations, in particular ones above 0.9%, a pressure-induced nitrogen content increase as part of a PESR route is in fact out of the question. This route is also unnecessary thanks to the low molybdenum content according to the invention that is compensated for by means of chromium and nitrogen. It is particularly advantageous if the ratio of nitrogen to carbon is greater than 15. The lower limit for nitrogen can be selected as 0.50, 0.52, 0.54, 0.60, or 0.65%. The upper limit for nitrogen can be selected as 0.80, 0.85, or 0.90%.

According to V. G. Gavriljuk and H. Berns; "High Nitrogen Steels," p. 264, 1999, CrNiMn(Mo) austenitic steels that are melted at atmospheric pressure like those according to the invention achieve nitrogen concentrations of 0.2% to 0.5%. In the prior art, only CrMn(Mo) austenites achieve Mn concentrations of 0.5 to 1%. With the alloy according to the invention, however, it is advantageous that it has been clearly possible to successfully achieve very much higher nitrogen concentrations than expected, without requiring a pressure-induced nitrogen content increase.

Moreover, boron, aluminum, and sulfur can be contained as additional alloy components, but they are only optional.

The present steel alloy does not necessarily contain the alloy components vanadium and titanium. Although these elements do make a positive contribution to the solubility of nitrogen, the high nitrogen solubility according to the invention can be provided even in their absence.

The alloy according to the invention should not contain niobium since it can result in precipitations, which reduces the toughness. Historically, niobium was used only for bonding to carbon, which is not necessary with the alloy according to the invention. Concentrations of up to 0.1% niobium are still tolerable, but should not exceed the concentration of inevitable impurities.

BRIEF DESCRIPTION OF THE DRAWING

The invention will be explained by way of example based on the drawing. In the drawing:

FIG. 1 shows a very schematic depiction of the production route.

DETAILED DESCRIPTION OF THE INVENTION

In accordance with the invention, the components shown in Table 1 are melted under atmospheric conditions and then undergo secondary metallurgical processing. Then, blocks are cast, which are hot forged immediately afterward. In the context of the invention, "immediately" means that no additional remelting process such as electroslag remelting (ESR) or pressure electroslag remelting (PESR) is carried out.

TABLE 1

| Alloy Components | | | |
|---|---|---|---|
| Alloying element | Composition range | Preferred | More preferred |
| Carbon (C) | 0.01-0.25 | 0.01-0.2 | 0.01-0.1 |
| Silicon (Si) | <0.5 | <0.5 | <0.5 |
| Manganese (Mn) | 3.0-8.0 | 4.0-7.0 | 5.0-6.0 |
| Phosphorus (P) | <0.05 | <0.05 | <0.05 |
| Sulfur (S) | <0.005 | <0.005 | <0.005 |
| Iron (Fe) | residual | residual | residual |
| Chromium (Cr) | 23.0-30.0 | 24.0-28.0 | 26.0-28.0 |
| Molybdenum (Mo) | 2.0-4.0 | 2.5-3.5 | 2.5-3.5 |

TABLE 1-continued

| Alloy Components | | | |
|---|---|---|---|
| Alloying element | Composition range | Preferred | More preferred |
| Nickel (Ni) | 10.0-16.0 | 12.0-15.5 | 13.0-15.0 |
| Vanadium (V) | <0.5 | <0.3 | below detection level |
| Tungsten (W) | <0.5 | <0.1 | below detection level |
| Copper (Cu) | <0.5 | <0.15 | <0.1 |
| Cobalt (Co) | <5.0 | <0.5 | below detection level |
| Titanium (Ti) | <0.1 | <0.05 | below detection level |
| Aluminum (Al) | <0.2 | <0.1 | <0.1 |
| Niobium (Nb) | <0.1 | <0.025 | below detection level |
| Boron (B) | <0.01 | <0.005 | <0.005 |
| Nitrogen (N) | 0.50-0.90 | 0.52-0.85 | 0.54-0.80 |

All values expressed in % by weight

With the alloy according to the invention, it is advantageous that a homogenization annealing or remelting is not necessary.

FIG. 1 shows an example of the possible processing routes for the production of the alloy composition according to the invention. One possible route will be described below by way of example. In the vacuum induction melting unit (VID), molten metal simultaneously undergoes melting and secondary metallurgical processing. Then the molten metal is poured into ingot molds and in them, solidifies into blocks. These are then hot formed in multiple steps. For example, they are pre-forged in the P52 forging press and are brought into their final dimensions in the rotary forging machine. Depending on the requirements, a solution annealing step and/or water cooling can also be performed.

In order to establish the final properties, the cold forming is performed in a rotary forging machine and the parts produced in this way then undergo further processing.

After the last hot forming sub-step, a rapid cooling to room temperature is carried out. With this special processing step, critical temperature ranges are passed through quickly and the formation of grain boundary precipitations is prevented. In the product according to the invention, it is clear that for example chromium nitride precipitations occur to a significantly lower degree, which influences the corrosion properties in an optimal way. Then the cold forming steps are carried out in which a strain hardening takes place. The degree of deformation in this case is between 10 and 50%.

According to the invention, it is advantageous if the following relation applies:

$$MARC_{opt}: 40 < wt\ \%\ Cr + 3.3 \times wt\ \%\ Mo + 20 \times wt\ \%\ C + 20 \times wt\ \%\ N - 0.5 \times wt\ \%\ Mn$$

The MARC formula is optimized to such an effect that it has been discovered that the otherwise usual removal of nickel does not apply to the system according to the invention and the limit of 40 is required.

Then the required cold forming steps are carried out in which a strain hardening takes place, followed by the mechanical processing, which in particular can be a turning or peeling.

A superaustenitic material according to the invention can be produced not only by means of the production routes described (and in particular shown in FIG. 2), the advantageous properties of the alloy according to the invention can also be achieved by means of a production route using powder metallurgy.

Table 2 shows three different variants within the alloy compositions according to the invention, with the respectively measured nitrogen values, which have been produced with the method according to the invention in connection with the alloys according to the invention. The resulting actual values of the nitrogen content are compared to the theoretical nitrogen solubility of such an alloy according to the prevailing school of thought. These very high nitrogen concentrations contrast with the nitrogen solubility indicated in the columns on the right according to Stein, Satir, Kowandar, and Medovar from "On restricting aspects in the production of non-magnetic Cr—Mn—N-alloy steels, Saller, 2005." In Medovar, different temperatures are indicated. It is clear, however, that the high nitrogen values far exceed the theoretically expected values.

TABLE 2

Examples of Alloy Compositions

| | Chemical composition (percentage by weight)/residual Fe | | | | | | | | | | | | | |
|---|---|---|---|---|---|---|---|---|---|---|---|---|---|---|
| Ex. | C | Si | Mn | Cr | Mo | Ni | V | W* | Cu | Co* | Ti* | Al* | Nb* | N** |
| A | 0.01 | 0.4 | 5.0 | 23.01 | 3.1 | 15.98 | 0.05 | 0 | 0.15 | 0 | 0 | 0 | 0 | 0.51 |
| B | 0.01 | 0.4 | 5.0 | 27 | 3.1 | 14 | 0.05 | 0 | 0.10 | 0 | 0 | 0 | 0 | 0.7 |
| C | 0.01 | 0.4 | 5.0 | 24 | 3.1 | 14 | 0.05 | 0 | 0.10 | 0 | 0 | 0 | 0 | 0.55 |

| | N solubility [% N]*** | | | | | | | |
|---|---|---|---|---|---|---|---|---|
| | Pressure | | | | Medovar at temperature: | | | |
| | [atm] | Stein | Satir | Kowanda | 1550° C. | 1525° C. | 1500° C. | 1450° C. |
| A | 1.00 | 0.36 | 030 | 0.34 | 0.34 | 0.35 | 0.36 | 0.39 |
| B | 1.00 | 0.61 | 0.41 | 0.65 | 0.47 | 0.49 | 0.51 | 0.56 |
| C | 1.00 | 0.44 | 0.34 | 0.45 | 0.38 | 0.40 | 0.41 | 0.45 |

*Values are below the detectable level
**Actual Value N
***Calculated values for N according to different methods
(Source: On Restricting Aspects in the Production of Nomagnetic Cr—Mn—Ni-Alloyed Steels, Saller, 2005)

This is even more astonishing since with the alloy according to the invention, a route was taken that does not justify the expectation of such a high nitrogen solubility, particularly because the manganese content, which has a very positive influence on the nitrogen solubility, is sharply reduced compared to known corresponding alloys.

In Table 3, the three alloys from Table 2 were produced using a method according to the invention and have undergone a strain hardening.

TABLE 3

Mechanical Properties of the alloys produced from Table 2 after strain hardening

| Alloy | Rp 0.2 [MPa] | Rm [MPa] | A4 [%] | Charpy V notch impact strength [Joule] | Rm * KV [MPa J] |
|---|---|---|---|---|---|
| A | 969 | 1111 | 30 | 271 | 301303 |
| B | 1171 | 1231 | 27 | 290 | 357236 |
| C | 1124 | 1207 | 26 | 329 | 370588 |

After this strain hardening, in all three materials, $R_{p0.2}$ was approximately 1000 MPa and the tensile strength Rm of each was between 1100 MPa and 1250 MPa. In addition, the notched bar impact work was in the outstanding range from 270 J to even greater than 300 J (alloy C-329.5 J).

It was thus possible to achieve an outstanding combination of strength and toughness; in all three examples, the product of Rm*KV was greater than 300000 MPa J.

The invention therefore has the advantage that a drilling collar alloy with an increased corrosion resistance and low nickel content has been produced, which simultaneously exhibits high strength and paramagnetic behavior. Even after the cold forming, a fully austenitic structure is present, with a magnetic permeability $\mu_r$<1.005 so that it has been possible to successfully combine the positive properties of an inexpensive chromium-manganese-nickel steel with the technically outstanding properties of a chromium-nickel-molybdenum steel.

The invention claimed is:

1. A drill string component, comprising an alloy including the following elements in percent by weight:

| Elements | |
|---|---|
| Carbon (C) | 0.01-0.10 |
| Silicon (Si) | <0.5 |
| Manganese (Mn) | 5.0-6.0 |
| Phosphorus (P) | <0.05 |
| Sulfur (S) | <0.005 |
| Chromium (Cr) | 26.0-28.0 |
| Molybdenum (Mo) | 2.5-3.5 |
| Nickel (Ni) | 13.0-15.0 |
| Vanadium (V) | below detection level |
| Tungsten (W) | below detection level |
| Copper (Cu) | <0.1 |
| Cobalt (Co) | below detection level |
| Titanium (Ti) | below detection level |
| Aluminum (Al) | <0.1 |
| Niobium (Nb) | below detection level |
| Boron (B) | <0.01 |
| Nitrogen (N) | 0.54-0.80 |

Iron (Fe) and
inevitable impurities residual.

2. The drill string component according to claim 1, wherein the alloy comprises the copper in an amount of greater than zero.

3. The drill string component according to claim 1, wherein the drill string component is produced by a method that includes secondary metallurgical processing of the alloy, casting the alloy into blocks immediately followed by hot forging, cold forming the alloy, and optionally subjecting the alloy to further mechanical processing.

4. The drill string component according to claim 3, wherein after the cold forming, the alloy has a magnetic permeability μr of less than about 1.01.

5. The drill string component according to claim 3, wherein the method further comprises strain hardening the alloy, wherein after the strain hardening, the alloy has a yield strength $R_{p0.2}$ of greater than about 1000 MPA.

6. The drill string component according to claim 5, wherein after the strain hardening, the alloy has a notched bar impact work at 20° C. of greater than about 80 J.

7. The drill string component according to claim 3, wherein after the cold forming, the alloy is fully austenitic.

8. A method for producing a drill string component, comprising the steps of: providing an alloy including the following elements in percent by weight:

| Elements | |
|---|---|
| Carbon (C) | 0.01-0.10 |
| Silicon (Si) | <0.5 |
| Manganese (Mn) | 5.0-6.0 |
| Phosphorus (P) | <0.05 |
| Sulfur (S) | <0.005 |
| Chromium (Cr) | 26.0-28.0 |
| Molybdenum (Mo) | 2.5-3.5 |
| Nickel (Ni) | 13.0-15.0 |
| Vanadium (V) | below detection level |
| Tungsten (W) | below detection level |
| Copper (Cu) | <0.1 |
| Cobalt (Co) | below detection level |
| Titanium (Ti) | below detection level |
| Aluminum (Al) | <0.1 |
| Niobium (Nb) | below detection level |
| Boron (B) | <0.005 |
| Nitrogen (N) | 0.54-0.80 |

Iron (Fe) and inevitable impurities residual;

melting the alloy:

subjecting the alloy to secondary metallurgical processing:

casting the alloy into blocks;

solidifying the alloy:

heating and immediately hot forming the alloy;

cold forming the alloy.

9. The method according to claim 8, wherein the hot forming comprises a plurality of sub-steps.

10. The method according to claim 9, further comprising reheating the alloy in between the hot forming sub-steps and after a last of the hot forming sub-steps and solution annealing the alloy after the last hot forming sub-step.

11. A steel alloy useful in forming a drill string component, comprising the following elements in percent by weight:

| Elements | |
|---|---|
| Carbon (C) | 0.01-0.10 |
| Silicon (Si) | <0.5 |
| Manganese (Mn) | 5.0-6.0 |
| Phosphorus (P) | <0.05 |
| Sulfur (S) | <0.005 |
| Chromium (Cr) | 26.0-28.0 |
| Molybdenum (Mo) | 2.5-3.5 |
| Nickel (Ni) | 13.0-15.0 |
| Vanadium (V) | below detection level |
| Tungsten (W) | below detection level |
| Copper (Cu) | <0.1 |
| Cobalt (Co) | below detection level |
| Titanium (Ti) | below detection level |
| Aluminum (Al) | <0.1 |
| Niobium (Nb) | below detection level |
| Boron (B) | <0.01 |
| Nitrogen (N) | 0.54-0.80 |

Iron (Fe) and inevitable impurities residual.

12. The steel alloy of claim 11, wherein the alloy comprises a superaustenite having a $PREN_{16}$ of $\alpha>42$, where PREN=% Cr+3.3×% Mo+16×% N.

13. The steel alloy of claim 11, wherein the alloy has a magnetic permeability μr of less than about 1.01.

14. The steel alloy of claim 13, wherein the magnetic permeability μr is less than about 1.005.

15. The steel alloy of claim 11, wherein the steel alloy has a yield strength $R_{p0.2}$ greater than about 500 MPa.

16. The steel alloy of claim 15, wherein the yield strength $R_{p0.2}$ is greater than about 1000 MPa.

17. The steel alloy of claim 11, wherein the steel alloy has a tensile strength Rm of at least about 1100 MPa.

* * * * *